US006917298B2

(12) United States Patent
Romano et al.

(10) Patent No.: US 6,917,298 B2
(45) Date of Patent: Jul. 12, 2005

(54) SOLAR SYSTEM ALARM BACKUP UNIT

(76) Inventors: William P. Romano, 204 Stephens La., Mahwah, NJ (US) 07430; Robert Mac Isaac, 1610 Rte. 23 North, Apt. 4, Butler, NJ (US) 07405

( * ) Notice: Subject to any disclaimer, the term of this patent is extended or adjusted under 35 U.S.C. 154(b) by 86 days.

(21) Appl. No.: 10/114,650

(22) Filed: Apr. 2, 2002

(65) Prior Publication Data

US 2003/0184446 A1 Oct. 2, 2003

(51) Int. Cl.[7] ..... G08B 21/00

(52) U.S. Cl. ..... 340/636.1; 340/636.2; 340/693.4; 340/333; 340/636.19

(58) Field of Search ..... 340/636.1, 636.12, 340/636.13, 636.15, 636.19, 646, 628, 632, 636.2, 693.2, 693.1, 693.4, 286.05, 333, 635

(56) References Cited

U.S. PATENT DOCUMENTS 4,434,395 A * 2/1984 Higuchi ..... 320/166
4,764,757 A * 8/1988 DeMarco et al. ..... 340/574
5,438,225 A * 8/1995 Berger ..... 320/102
5,563,456 A * 10/1996 Berger ..... 307/66
5,883,577 A * 3/1999 Jordan ..... 340/628
6,157,168 A * 12/2000 Malik ..... 320/128
6,201,370 B1 * 3/2001 Reller et al. ..... 320/107
6,587,051 B2 * 7/2003 Takehara et al. ..... 340/635

* cited by examiner

*Primary Examiner*—Jeffery Hofsass
*Assistant Examiner*—Daniel Previl
(74) *Attorney, Agent, or Firm*—W. Patrick Quast, Esq.

(57) ABSTRACT

A backup electrical power unit for an alarm panel. The unit comprises a solar panel array which produces an array output DC voltage and a charging current for a battery through a first circuit at a first voltage level of the battery output voltage. This circuit disconnects the array output from the battery terminal output at a second battery voltage level. The charging current resumes when the battery output voltage is at or below the first voltage level. The backup unit also includes a second circuit interposed electrically, serially with the first circuit to disconnect the array output from the battery terminal output below a disconnect, voltage level. A circuit is provided for connecting the battery to the alarm panel when the primary power to the alarm panel is interrupted. Status indicators are provided.

21 Claims, 4 Drawing Sheets

POWER ON RESET CIRCUITRY
BATT_GOOD
FEED
ENGAGE
LED4 *FLASHING
PCB MOUNT Iled = 20mA
PO_RESET
-PO_RESET
-LVD
ASTABLE
-TRIGGER
+TRIGGER
Vdd
Vss
Vbatt
V+
36
38
40
44
45
46
47
52
54
56
58
60
62
64
66
120
122
124
126
128
130
132
134
136
137
138
140
144
164
166
168
170
174
178
180
182
184

SOLAR SYSTEM ALARM BACKUP UNIT

FIELD OF THE INVENTION

This invention relates to auxiliary backup electrical power units for alarm systems and particularly to a system which uniquely provides additional alarm system backup energy capacity.

BACKGROUND OF THE INVENTION

Numerous monitoring systems exist which provide a sensory, status indication of an environment or condition under watch. Alarm systems serve to monitor unwarranted intrusions to areas or equipment; smoke contamination; equipment parameter and operational conditions; and other conditions or circumstances.

Typically there is a primary source of power to operate these systems. It is usually derived from the principal, AC electrical energy otherwise available at a location for the lighting and other power needs of the site.

Of course, the obvious concern with these AC powered systems is how they will perform when there is a power failure, so that the primary source of energy is unavailable. Backup power systems are a necessity.

Many monitoring systems included DC battery, power supplies which are interfaced with the circuitry so as to permit a switch over when there is a failure; and a cutout when primary AC power is restored. Without more, this is sufficient for short term AC power failures, as long as the power drain from the battery, for the period of time involved, does not exceed its amp-hour capacity.

Unfortunately, although the power drain of the system is ascertainable, the period of interruption, in may cases, is not. So, unless there is a way to augment or replenish the DC battery power, this basic system is impractical, except for highly predictable circumstances.

One straight forward solution would be to increase the size and/or number of batteries providing the backup power. Of course the obvious, logistical drawbacks of such an approach due to weight and size discourage its use.

If a suitable approach to replenishing the spent dc power were available, this would address the problem. One such general approach utilizies the "endless" or "free" source of energy, the sun, to recharge the batteries. Numerous, specific adaptations exist including those described in the following U.S. Pat. No. 4,862,141; apparently U.S. Pat. No. 5,883,527 (see below); U.S. Pat. Nos. 5,438,225; 5,563,456; 4,890,093 and 4,764,757.

In U.S. Pat. No. 4,862,141, a bank of solar cells charges a battery that powers both the smoke detector and intrusion alarm. This system uses the solar cells as a primary source of power. House current is not used to supply power to the alarm and detector. This is not a backup system.

In the embodiment of FIG. 2 of U.S. Pat. No. 5,883,577, house current normally supplies power to the smoke detector. In the event of power outage, battery 21, charger/regulator 22, and solar cell array 13 somehow provide power to the detector. No schematic is given, so the nature of this circuit is unclear. In the event the backup battery 21 is removed or damaged, somehow the solar cell array 13 and charger/regulator 22 will supply power to the detector. The second embodiment of FIG. 5 has two chargers/regulators. One charger/regular is powered by house current and normally supplies power to both operate the detector and also trickle charge the battery 21. In the event of a power outage, this same charger/regulator supplies power to the detector, presumably from battery 21 or solar cell array 13 (but at col. 4, lines 9 through 16, the specification seems to be saying that the battery is now somehow charged during power outage). In the event the battery 21 is damaged or removed the other charger/regulator somehow comes into play and draws power from the solar cell array to power the detector.

In U.S. Pat. No. 5,438,225, a solar cell 15 (FIG. 3) operates through regulator 16 as the primary power source for voltage at terminal 40. Cell 15 normally charges backup battery 18 through charger 19. If cell voltage is low, battery 18 then provides power. If voltage sensor 41 detects a low battery voltage, it closes switch 42 to draw power from the capacitive discharge ignition system, to provide power through regulator 45 to terminal 40. See also U.S. Pat. No. 5,563,456, which is a CIP of the '225 patent.

In U.S. Pat. No. 4,890,093, solar cell 1 charges battery 3 through blocking diode 2. Battery 3 provides power to the converter block 2, which supplies power to the motion sensor in block 4. Motion sensed by block 4 produces a persistent signal that is sent to block 3 to illuminate the security light 10, if: (1) photocell 11 indicates a relatively dark ambient, and (2) the voltage from battery 3 is sufficiently high.

In U.S. Pat. No. 4,764,757, a security system has a number of stations that can activate several alarms when distress signals are received from a portable transmitter. The stations each have a solar cell that trickle charges a battery. The battery is the primary power source for the alarms.

In these various patents solar cells may be utilized as part of the primary source of power and not a part of a backup circuit design. Alternately they form a part of a battery charging system as well as the primary source of power, so that the battery can provide power, if the cell voltage is too low. Trickle current circuitry is described in at least one of the patents as the mechanism for charging the battery.

Although these patents detail various solutions, the approach of the present invention is unique and accomplishes the primary object of providing an intelligent control of the charging of an integral 12 volt DC back up battery from a solar panel array.

Further the present invention realizes the additional advantages by providing:

1) means to monitor the presence of local AC power and to detect and signal the loss of said local AC power;

2) means to include or ignore the local alarm panel's supervisory "flag" as to the status of local AC power presence;

3) means to connect in parallel ("tag on") the integral solar charged battery to the panel backup battery terminals under the conditions of local AC power loss and to disconnect the integral battery upon return of local AC power;

4) means to sense the backup battery voltage level going below a predetermined DC voltage and to disconnect the backup battery from the "tag on" subsystem and solar charger upon detection of said condition and to signal said condition, and conversely, the means to connect the backup battery to the "tag on" subsystem and solar charger when the voltage level rises above the predetermined threshold; and, 5) means to deliver system status information to outside systems by way of terminal block connections.

Toward the accomplishment of these objects and advantages, a preferred embodiment of the unique backup unit of the present invention is described. A full understanding will be facilitated by reference to the accompanying drawings which are described in the following section. After a reading hereof a further appreciation of the stated objects and advantages as well as others will be apparent.

SUMMARY OF THE INVENTION

Towards the accomplishment of these and other advantages, a backup electrical power unit is described for use in providing a backup power supply to an alarm panel when primary power to the alarm panel is interrupted. The backup unit comprises a solar panel array, including an array output, said array producing an array DC voltage and a charging current at said array output. It further includes a battery including a battery terminal output having a battery output voltage. A first means, interposed electrically between said array output and said battery terminal output, for electrically connecting said array output to said battery terminal output at a first voltage level of said battery output voltage and for disconnecting said array output from said battery terminal output at a second voltage level of said battery output voltage, whereby said charging current stops flowing to charge said battery when said second voltage level is reached or exceeded, and said charging current resumed so as to charge said battery, when said battery output voltage is at or below said first voltage level is provided.

The backup electrical power unit claimed further comprises a second means interposed electrically, serially with said first means, between said array output and said battery terminal output, said second means for electrically connecting said array output to said battery terminal output above a third voltage level of said battery output voltage, said second means electrically disconnecting (low voltage disconnect) said array output from said battery terminal output below said third voltage level. The first voltage level in the preferred embodiment is 13.5 volts DC, while the second voltage level is 14.3 volts DC. The third voltage level (low voltage disconnect) is 11.3 volts DC.

Means are provided for connecting said battery output voltage to the alarm panel when the primary power to the alarm panel is interrupted. Various means are claimed for indicating: that said backup electrical power unit has been engaged; when there has been a loss of primary power to the alarm panel; and, that said battery output voltage is below said third voltage level. Also means are claimed for including or ignoring the fact that there has been a loss of primary power in the alarm panel with the battery engaged, indicating means.

DESCRIPTION OF THE PREFERRED EMBODIMENT

Figure 1:
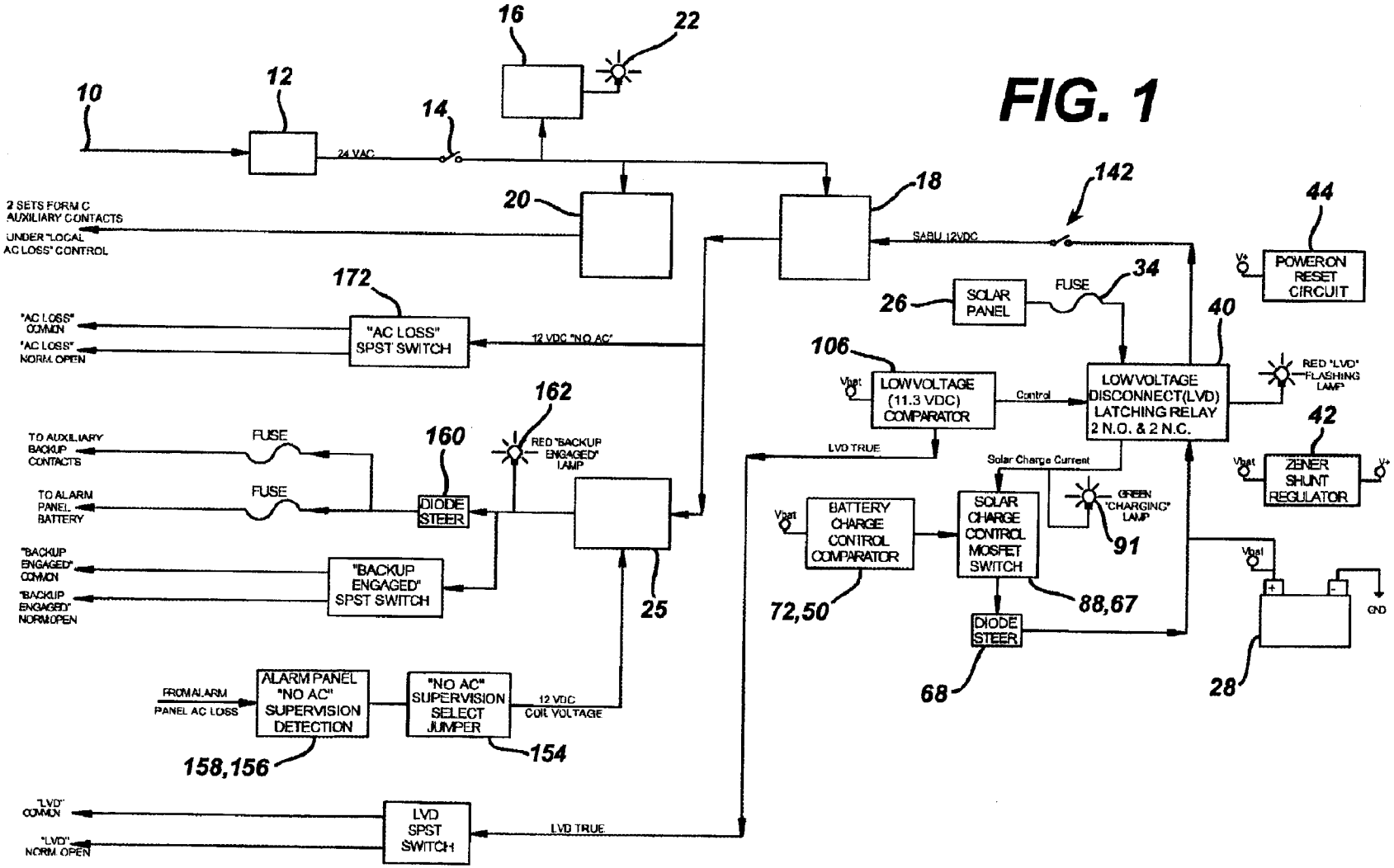
FIG. 1 depicts a block diagram of the alarm system backup unit of the present invention.
Figure 2:
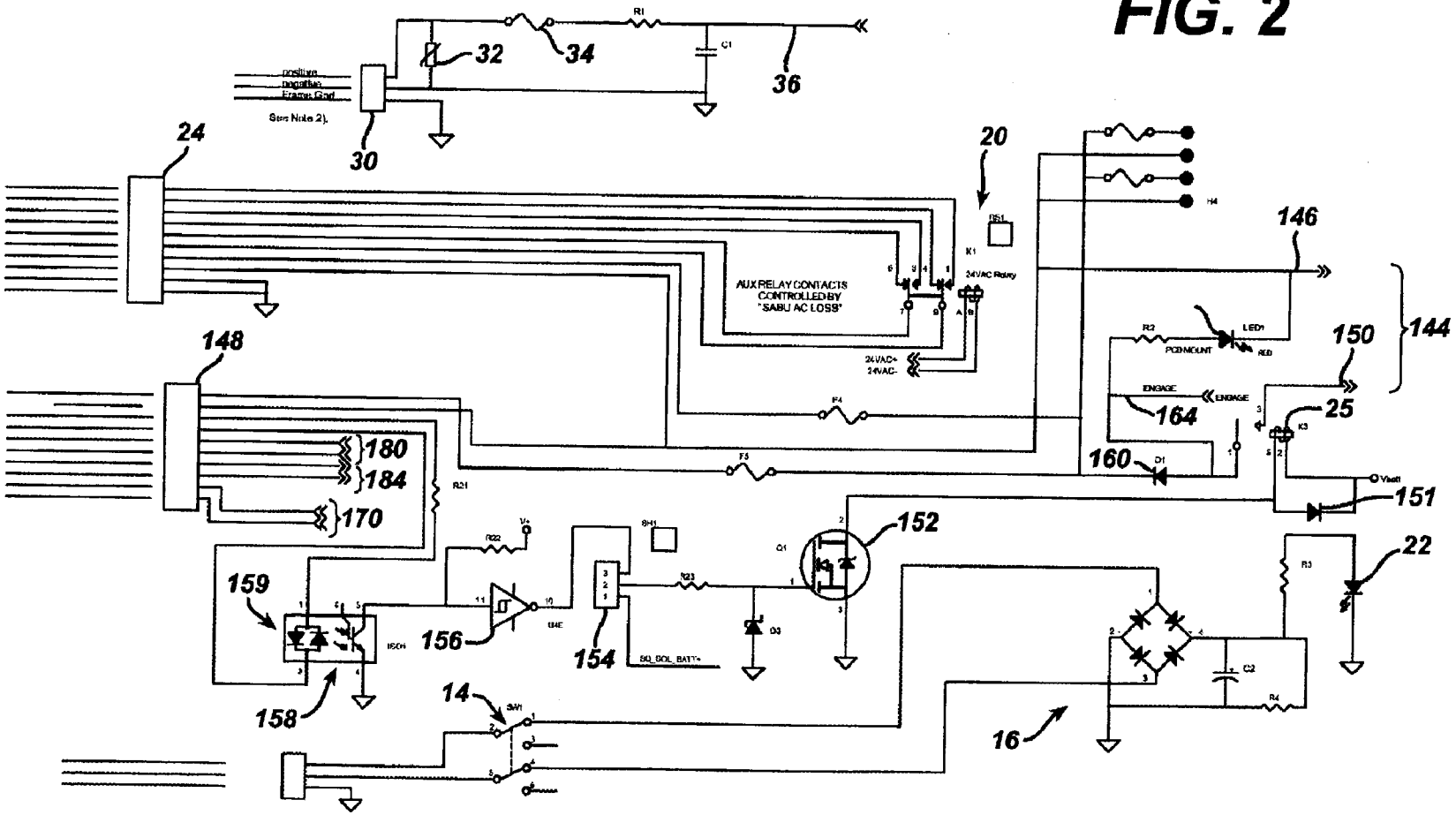
FIG. 2 is a detailed schematic of a portion of the circuitry implementing the present invention.
Figure 3A:
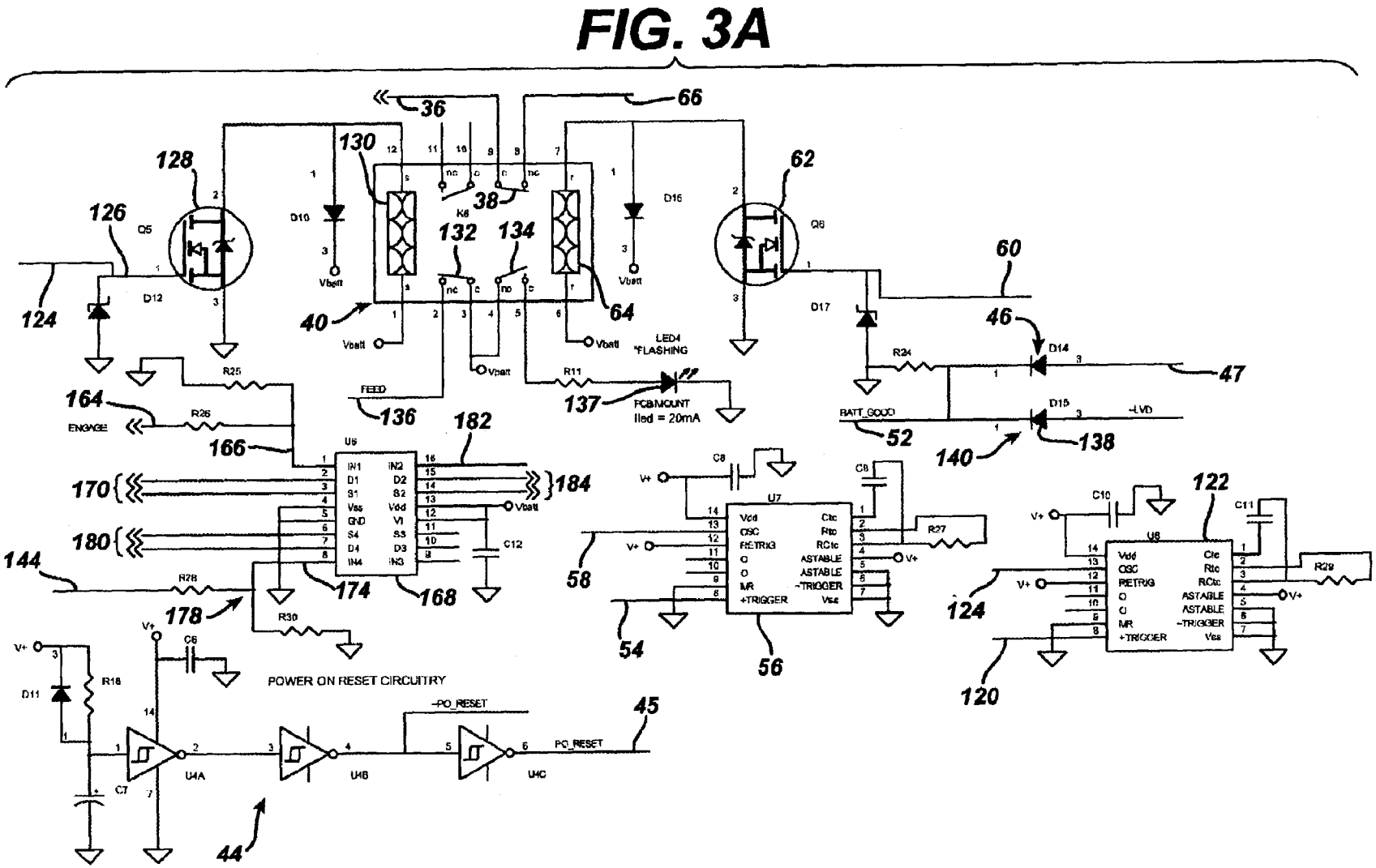
FIGS. 3A and 3B are detailed schematics of further portions of the circuitry implementing the present invention.
Figure 3B:
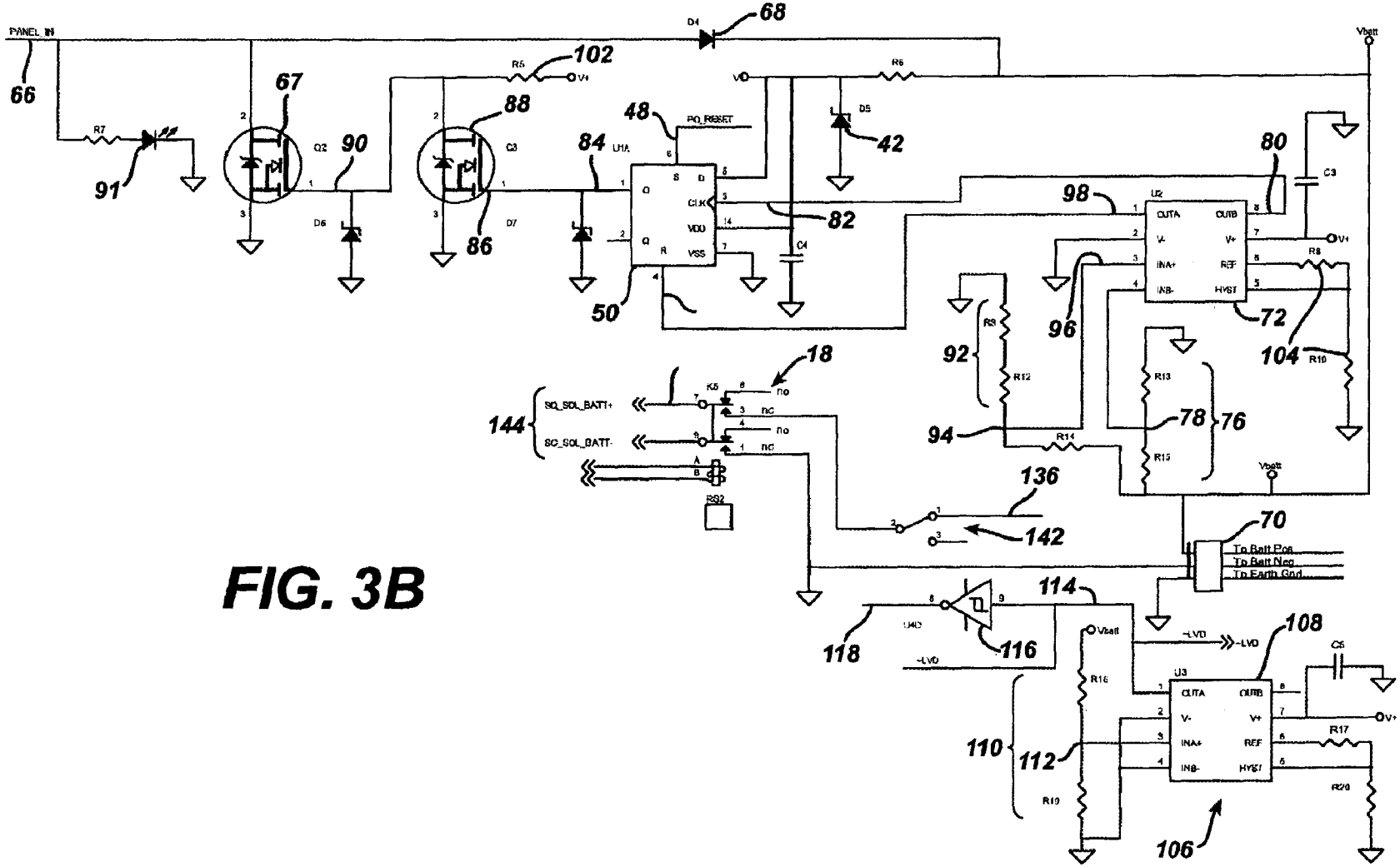

In order to best understand the following description it is thought that a discussion of the functional schematic of FIG. 1 accompanied by cross references to the detailed circuitry of FIGS. 2, 3A and 3B, as necessary, is a preferred approach.

The backup circuitry and associated elements are housed in a circuitry panel, not shown, which is efficiently packaged to minimize the resulting size and to facilitate its location at the site to be monitored.

Unless otherwise indicated, all connections in the referenced schematics, and relay positions, are shown based on the assumption that the AC voltage is present and that the battery voltage, V batt, is above the selected, low voltage disconnect level as discussed below.

The backup unit draws its power from the business or resident primary power line, for example, 120 VAC. This is supplied on input line 10. The 120 VAC is supplied to a 24 Vac step down transformer 12. The secondary, 24 AC voltage, is supplied through a test switch 14 to a bridge rectifier circuit 16, and to the coils of two (2), 24 VAC, DPDT, Form C relays, 18 and 20.

The output of Bridge rectifier circuit 16 is connected through a limiting resistor to an LED 22 status lamp mounted in the face of the panel and which provides a visual indication that 24 VAC is present at the system.

All six of the relay contacts of auxiliary relay 20 (see FIG. 2) are brought out to a terminal block 24 mounted on the panel. These would provide optional utilization for a customer when AC power is lost. For example, they can be electrically connected to a remote monitoring station(s) to enable continuous monitoring of the power status.

When the primary voltage is lost, the 24 VAC output from transformer 12, of course, is also lost. LED 22 would indicate this fact. Relay 18 would be de-energized enabling the backup power supply to provide the necessary DC voltage to the alarm circuitry through "AC loss" spst relay switch 25.

A solar array panel 26 and a 12 VDC lead acid battery 28 are located separately from the circuitry panel. The amp-hour capacity of the battery is selected based upon an alarm system's unique parameters. The nominal voltage is 12 VDC.

The solar cell array panel provides charging current to the battery. The output power rating of the panel is based on the circuit and battery parameters. The positive, negative and frame ground terminals of the solar array panel are connected to the circuitry panel through terminal block 30 (FIG. 2 ). A surge arrestor 32 is positioned across the array panel input. The positive side of the array input is fed through a resettable fuse 34 whose current rating, for example, four amps, is selected to accommodate the charging current determined for the battery 28 and, as well, to ensure that excessive current capable of damaging the solar may panel is not drawn by the backup unit. The array panel voltage is filtered and is supplied through a panel connection 36 to a normally closed set of contacts 38 of a low voltage disconnect latching relay, 40 (FIG. 3A).

In order to provide regulated power to the system control circuitry, a Zener shunt regulator 42 is employed (FIG. 3B). The shunt regulator draws on the battery power to produce a regulated output, V+. In the circuit design depicted, V+ is 9.1 v.

"Power On" reset circuitry 44 (FIGS. 1 and 3A) employs three serially connected "D" type flip-flops to insure that all system control circuits enter initial operation under a known circuit state condition. The reset circuitry generates a "PO reset" pulse voltage of V+ at turn on at output 45 which is supplied to one input 47 of "OR" circuitry 46. The "PO reset" pulse signal is also supplied to the set input 48 of battery charge control comparator 50 (FIG. 3B). The above and immediately following discussion assumes the battery voltage is above a low voltage disconnect level which will be discussed hereinafter.

"OR" circuitry 46 provides a V+ gate voltage at its output 52 which is supplied to the trigger input 54 of mono-stable multi-vibrator 56. Once triggered the multi-vibrator produces a pulse-shaped voltage of V+ magnitude at output 58 which in turn is supplied to the gate 60 of N-channel mosfet, 62. The mosfet turns on, providing a ground return for one of the coils, 64, of latching relay 40. The schematic depicts the condition of the relay contacts for the latching relay 40 when coil 64 is energized, as just described. The nature of the latching relay is that, once energized, the coil voltage can be removed but the relay contact change remains until the other coil is pulsed.

As such, in this circumstance, the array panel voltage provided at panel connection 36 is supplied to the "panel in" terminal 66 through closed contacts 38. Assuming the battery voltage is above its Low Voltage Disconnect (LVD) level and assuming further that the battery voltage is below an upper voltage threshold for terminating the charging of the battery, all to be discussed hereinafter, then N channel mosfet 67 (FIG. 3B) will be open and the solar panel voltage and its available charging current will be supplied through steering diode 68 to the positive terminal of the battery 28 through terminal block 70.

BATTERY CHARGE CONTROL CIRCUITRY

Comparator 72 (in fact, a dual comparator in one package) and 50, and mosfets 67 and 88 cooperate to regulate the charging of the battery 28 by the solar panel array between a range of voltages. The range presently set is between 13.8 and 14.3 VDC. If the battery voltage is above 14.3 VDC the charging circuitry is shunted by mosfet 67 and battery charging is terminated. If the voltage reaches or drops below 13.8 VDC the charging resumes, unless the battery voltage is below the LVD voltage, for example, 11.3 VDC.

Assume the battery voltage, V batt, is between 11.3 and 13.8 VDC. The voltage divider resistive network 76 (FIG. 3B) is set up such that the voltage at juncture 78, which is coupled to the input of one of the comparators in dual comparator 72, is of a value to trigger a gate voltage of V+ at output 80 which in turn is coupled to clock input 82 of comparator 50. A V+ gated voltage appears at output 84 to drive the gate 86 of mosfet 88. This turns on mosfet 88, shorting to ground the gate 90 of mosfet 67 and cutting it off. As such, the solar panel voltage and charging current at terminal 66 can be directed through steering diode 68 to initiate (or continue) the charging of the battery. At this time LED 91 is energized to thus give a visual indication that the charging circuit is operating.

As the battery voltage rises and reaches 14.3 VDC, resistor divider network 92 (FIG. 3B) results in a voltage at juncture 94, input 96 to the second comparator in dual comparator 72, which results in a reset voltage change at output 98 which in turn is coupled to reset input 100 of comparator 50.

The voltage of output 84 (and gate input 86) goes to zero. This turns off mosfet 88 which allows the V+ voltage through resistor 102 to turn on mosfet 67 thereby shunting the solar array panel current to circuit ground, thereby inhibiting its battery charging ability. Provided the battery voltage does not drop below the low voltage disconnect threshold (e.g. 11.3 VDC), the charging circuitry cuts out when V batt reaches 14.3 volts on the way up and is turned on, as V batt decreases, when it reaches 13.8 volts. This gentle internal charging of the battery is a significant improvement over the continuous trickle charge, prior art designs which ultimately degrade the battery life.

Resistor divide network 104 (FIG. 3B) is used to create this dead band between the 14.3 volt and 13.8 volt levels.

The ability to readily change the charge cutout range through the manipulation of resistor values in divider networks expands the potential of this design to accommodate all types of backup batteries with various charging voltage requirements.

LOW VOLTAGE DISCONNECT

The low voltage disconnect circuitry 106 (FIG. 3B) includes a comparator 108. A resistor divider network 110 is placed across the battery voltage, V batt. The junction voltage at 112 is supplied to the input of the comparator. The resistor values in network 110 are selected for given comparator specifications so as to create a low voltage disconnect pulse at output 114 when V batt drops to a predetermined cut off voltage, for example 11.3 VDC. At this level the present circuitry will disconnect the solar panel feed to the battery charging circuitry; disconnect the battery 28 from the backup feed path; and provide a warning that the battery voltage has dropped below the disconnect value. When the LVD comparator circuit detects a positive going voltage level crossing the 11.3 volt threshold, a further pulse is fired which reestablishes the "connect" status. I.e., the solar panel feed to the charging circuitry is re-established and the battery voltage is reconnected to the backup feed path. The specifics of the implementing circuitry follow.

The voltage pulse at output 114, responding to the battery voltage falling below 11.3 VDC, is a negative excursion pulse, from V+ to zero volts. This is supplied to a D type flip-flop 116, which produces the inverse or positive excursion pulse at its output 118 at this time. The output 118 is fed to the input 120 of a second monostable multivibrator 122 (FIG. 3A) which produces a positive gate pulse voltage at output 124 in response to the input signal. The output 124 is tied to the gate input 126 of mosfet 128 which turns on in response to the positive gate pulse voltage. A return path to ground is thus provided to the second coil 130 of latching relay 40 such that it is energized. This causes a change in state for relay contacts 38, 132 and 134. As a consequence, the solar panel feed is interrupted through the opening of contacts 38. V batt is now disconnected (due to the opening of contacts 132) from the "Feed" terminal 136 through which it was provided as a back up to the alarm circuitry (to be discussed below). Contemporaneously, through relay contacts 134, now closed, V batt is connected to an LED 137 which flashes e.g. a flashing red light, signifying that the LVD threshold has been reached and that the above results have occurred.

When the V batt increases, and crosses the LVD threshold, the output voltage at output 114 changes from zero to V+. The output 114 is connected to the anode 138 of a second diode 140 of the "OR" gate 46 (FIG. 3A). The V+ voltage is seen at output 52 which is connected to input 54 of the monostable multivibrator 56. Output 58 pulses high, gating on mosfet 62 so as to provide a return path for coil 64, energizing it and thus again changing the contact arrangement of contacts 38, 132 and 134. This reestablishes the solar feed to the charging circuitry and the battery feed to the alarm unit through contacts 132. The low voltage disconnect warning is now interrupted so that LED 137 no longer flashes.

The backup feed path through contacts 132 and as presented at the terminal 136, continues through a service switch 142 (FIG. 3B), which is manually activated, as desired, to break the feed path for diagnostic testing and repairs. The feed path continues through the relay contacts of relay 18 (remember, the 24 AC is not present at this time)

to pins 144 in an internal panel connector (not shown). The path continues in FIG. 2. The battery negative lead 146 continues directly to alarm panel interface terminal 148 and auxiliary terminal 24.

The battery positive lead 150 is connected to the fixed relay contact of the spst "AC loss" relay 25 which is depicted in its unenergized state. The coil of this relay on one side is connected to V pos. bat through diode 151. The remaining side is tied to the drain terminal of mosfet 152. Mosfet 152 is gated on when a positive voltage appears at terminal 2 of jumper block 154. Terminal 1 of jumper block 154 is tied to the solar battery positive voltage, as available, for example, when there is a loss of AC power to the backup unit. Terminal 3 of jumper block 154 is tied to the output of flip-flop 156 which in turn is driven by an opto isolator circuit 158. The input leads of the opto isolator circuit are connected to appropriate terminals of the alarm panel interface connector 148. There will be, typically, a twelve volt DC voltage at these terminals when there is a loss of AC power in the alarm panel. This may or may not occur with the loss of AC power to the backup unit. Assuming a loss of AC power in the alarm panel, the 12 volt DC signal, which is present and which could be of either polarity, is imposed across the back to back diodes 159. This causes the transitor portion of the isolator to trigger on, creating a change of state, from V+ to zero volts, at its output and the input to the flip-flop 156. The output of the flip-flop, tied to terminal 3, changes from zero to V+ volts.

The "No AC" indication from the alarm panel thus can be utilized to further qualify the "Tag On" connection of the backup unit integral battery 28 onto the alarm system battery. This is done by jumping terminal 3 to terminal 2 of jumper block 154, so that the energization of relay 25 occurs because the alarm panel has lost its AC power. If the installer chooses not to qualify the "Tag On" of the backup unit, then he would jumper terminal 1 to terminal 2 of the jumper block 154. In this situation relay 25 would be energized if AC power to the backup unit was lost, irrespective of whether or not the alarm panel lost power.

Once relay 25 is engaged, the backup battery voltage at lead 150 passes through its relay contacts, through steering diode 160 and through fused output leads, one to the alarm panel connector 148 and another to the auxiliary connector 24. The latter may be optionally used by the installer to power additional lamps, sirens, etc. Also, the battery voltage at lead 150, when relay 25 is energized drives a "backup engaged" LED, 162, which signals that the backup battery is being used. The anode of steering diode 160 is made available via lead 164 to provide remote signaling of the engagement of the backup unit as explained below.

Lead 164 is connected through a resistor divider network to an input 166 of one of four fet switches packaged in 168 (FIG. 3A). The corresponding fet switch produces a gated signal at terminals 170 which is connected to the alarm panel interface connector 148 for remote monitoring of the backup unit engagement status.

A second fet switch, shown functionally in FIG. 1 as 172, but contained in quad fet switch package 168, receives an input signal at input 174 when the backup unit loses AC power and relay 18 is de-energized. The backup unit battery voltage now appears on lead 176 attached to the wiper contact of the relay 18 which in turn is tied through a resistor network 178 to input 174. The output of the second fet appears on output line 180 of the quad fet package 168 and is also supplied to the alarm panel interface connector 148.

A third fet switch in the quad package 168 receives the LVD indication on line 118 (FIG. 3B) at its input 182. The output of this fet, appearing on lines 184 is also made available to corresponding terminals on the alarm panel interface connector 148.

The various electrical component types and values identified herein and appearing on the drawings should be sufficiently familiar to and/or developable by those of ordinary skill in the circuit design art.

For informational purposes, the inventors herein identify the following, select solid state components by reference number, manufacturer and manufacturer's part number. Further all components are available through distributors in the US and specifically, NEWARK ELECTRONICS COMPANY, having distributor offices throughout the United States; and DIGIKEY CORPORATION located in Thief River Falls, Minn.

The significant solid state components identified are:

| REF. NO. | PART NO. | MANUFACTURER |
|---|---|---|
| 67 | IRL 3705N | International Rectifier |
| 62, 88 | IRL L3303 | International Rectifier |
| 128, 152 | | |
| 158 | OPTO Isolator | Toshiba |
| 50 | CD4013BCM | Fairchild |
| 72, 108 | LTC1442 | Linear Tech |
| D style Flip-flops | CD40106 | Fairchild |
| (e.g. 44, 116, 156) | | |
| 168 | DG 412 | Maxim |
| 56, 122 | CD4047 | Fairchild |

While a specific preferred embodiment has been described, alternative means for implementing the various circuit functions will now be apparent. Therefore, it is not intended, of course, to limit the scope of the invention to what has been described. Rather the invention is to fined by the breadth of the claims which follow.

What is claimed:

1. A backup electrical power unit for use in providing a backup power supply to an alarm panel when primary power to the alarm panel is interrupted, said backup unit comprising:

(a) a solar panel array, including an array output, said array producing an array DC voltage and a charging current at said array output;

(b) a battery, including a battery terminal output having a battery output voltage; and (c) a first means, interposed electrically between said array output and said battery terminal output, for electrically connecting said array output to said battery terminal output at a first voltage level of said battery output voltage and for disconnecting said array output from said battery terminal output at a second voltage level of said battery output voltage, said second voltage level higher than said first voltage level such that a dead band is created between said second voltage level and said first voltage level, whereby said charging current stops flowing to charge said battery when said second voltage level is reached or exceeded, and said charging current does not resume its flow so as to charge said battery, until said battery output voltage drops to or below said first voltage level, said first means including circuit means for setting said first voltage level, said first means further including other circuit means for setting said second voltage level such that the dead band between the first and second voltage levels can be varied as determined by an operator.

2. The backup electrical power unit claimed in claim 1 further comprising:

a second means interposed electrically, serially with said first means, between said array output and said battery terminal output, said second means adapted for electrically connecting said array output to said battery terminal output above a third voltage level of said battery output voltage, said third voltage level below said second voltage level, said second means adapted for electrically disconnecting said array output from said battery terminal output below said third voltage level, said second means including circuit means for setting said third voltage level such that said third voltage level can be varied as determined by an operator.

3. The backup electrical power unit claimed in claim 2 wherein said first voltage level is 13.5 volts DC and said second voltage level is 14.3 volts DC.

4. The backup electrical power unit claimed in claim 3 wherein said third voltage level is 11.3 volts DC.

5. The backup electrical power unit claimed in claim 2 wherein said third voltage level is 11.3 volts DC.

6. The backup electrical power unit claimed in claim 2 further comprising, means for connecting said battery output voltage to the alarm panel when the primary power to the alarm panel is interrupted.

7. The backup electrical power unit claimed in claim 6 further comprising means for indicating that said backup electrical power unit has been engaged, including a first output signal.

8. The backup electrical power unit claimed in claim 7 wherein the alarm panel includes means for indicating the loss of primary power to the alarm panel including a second output signal, said means for indicating that said backup electrical power unit has been engaged further comprising means to include or ignore said second output signal when said first output signal has been produced.

9. The backup electrical power unit claimed in claim 8 further comprising means for indicating that said battery output voltage is below said third voltage level.

10. The backup electrical power unit claimed in claim 9 further comprising means for indicating that the primary power is interrupted.

11. The backup electrical power unit claimed in claim 2 further comprising means for indicating that said battery output voltage is below said third voltage level.

12. The backup electrical power unit claimed in claim 6 further comprising means for indicating that said battery output voltage is below said third voltage level.

13. The backup electrical power unit claimed in claim 7 further comprising means for indicating that said battery output voltage is below said third voltage level.

14. The backup electrical power unit claimed in claim 13 further comprising means for indicating that the primary power is interrupted.

15. The backup electrical power unit claimed in claim 6 further comprising means for indicating that the primary power is interrupted.

16. The backup electrical power unit claimed in claim 12 further comprising means for indicating that the primary power is interrupted.

17. The backup electrical power unit claimed in claim 1 wherein said first voltage level is 13.5 volts DC and said second voltage level is 14.3 volts DC.

18. The backup electrical power unit claimed in claim 1 further comprising, means for connecting said battery output voltage to the alarm panel when the primary power to the alarm panel is interrupted.

19. The backup electrical power unit claimed in claim 18 further comprising means for indicating that said backup electrical power unit has been engaged, including a first output signal.

20. The backup electrical power unit claimed in claim 19 wherein the alarm panel includes means for indicating the loss of primary power to the alarm panel including a second output signal, said means for indicating that said backup electrical power unit has been engaged further comprising means to include or ignore said second output signal when said first output signal has been produced.

21. The backup electrical power unit claimed in claim 18 further comprising means for indicating that the primary power is interrupted.

* * * * *